US007926321B2

(12) United States Patent
Rollins et al.

(10) Patent No.: US 7,926,321 B2
(45) Date of Patent: Apr. 19, 2011

(54) ROCKER SWITCH

(75) Inventors: Nathan Rollins, Boylston, MA (US); Samuel Millen, Somerville, MA (US); David Carpenter, Jaffrey, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 12/925,795

(22) Filed: Oct. 29, 2010

(65) Prior Publication Data

US 2011/0048098 A1 Mar. 3, 2011

Related U.S. Application Data

(63) Continuation of application No. 11/900,383, filed on Sep. 11, 2007, now Pat. No. 7,841,223.

(60) Provisional application No. 60/851,525, filed on Oct. 12, 2006.

(51) Int. Cl.
*B21D 39/00* (2006.01)
*B21J 9/14* (2006.01)

(52) U.S. Cl. ..... 72/453.15; 72/453.02; 30/134; 60/407; 29/751

(58) Field of Classification Search ..... 72/453.02, 72/453.15, 453.16; 30/134; 60/407; 29/751
See application file for complete search history.

(56) References Cited

U.S. PATENT DOCUMENTS

| | | | | |
|---|---|---|---|---|
| 5,243,761 | A | 9/1993 | Sullivan et al. | 30/134 |
| 5,553,478 | A | 9/1996 | Di Troia | 72/453.15 |
| 5,727,417 | A | 3/1998 | Moffatt et al. | 72/453.03 |
| D408,242 | S | 4/1999 | Yamamoto | D8/61 |
| 6,401,515 | B2 | 6/2002 | Frenken | 72/453.15 |
| 7,254,982 | B2 | 8/2007 | Frenken | 72/453.15 |
| 7,487,654 | B2 | 2/2009 | Lefavour et al. | 72/31.01 |
| 7,640,780 | B2 | 1/2010 | Ruland | 72/453.18 |
| 7,841,223 | B2 * | 11/2010 | Rollins et al. | 72/453.15 |

FOREIGN PATENT DOCUMENTS

| | | |
|---|---|---|
| GB | 805923 | 12/1958 |

OTHER PUBLICATIONS

Montminy, A. T. et al., "Hydraulic Tool With Wobble Plate Transmission", U.S. Appl. No. 11/429,039, filed May 4, 2006.

* cited by examiner

*Primary Examiner* — David B Jones
(74) *Attorney, Agent, or Firm* — Harrington & Smith

(57) ABSTRACT

Disclosed herein is a hydraulic tool user interface. The hydraulic tool user interface includes a rocker section, a drain trigger section, and an activation trigger section. The rocker section includes a first end, a second end, and a first contact portion. The first contact portion is between the first end and the second end. The first contact portion is configured to contact a drain pin. The drain trigger section is at the first end. The activation trigger section is between the first end and the second end. The activation trigger section is configured to contact the second end. The activation trigger section is configured to contact an electrical switch.

20 Claims, 5 Drawing Sheets

ROCKER SWITCH

CROSS REFERENCE TO RELATED APPLICATION APPLICATIONS

This is a continuation patent application of U.S. patent application Ser. No. 11/900,383 filed on Sep. 11, 2007, now U.S. Pat. No. 7,841,223. This application also claims priority under 35 U.S.C. §119(e) to U.S. provisional patent application No. 60/851,525 filed Oct. 12, 2006 which is hereby incorporated by reference in its entirety.

BACKGROUND OF THE INVENTION

1. Field of the Invention

The invention relates to a hydraulic tool and, more particularly, to a tool having a user interface with a rocker switch.

2. Brief Description of Prior Developments

Hydraulic power tools are employed in numerous applications to provide a user with a desired mechanical advantage. One example application is a battery powered hydraulic crimp tool. Many conventional hydraulic tools have user interfaces, or user controls, generally comprising an activation trigger and a separate retract, or drain, trigger. One drawback to the conventional configurations is that the triggers may be inadvertently depressed when the tool is set down on a surface or if the tool is accidentally bumped or knocked against another object. If both the activation and drain triggers are depressed at the same time, the tool's hydraulic fluid will cycle through the tool without the pump building pressure. Accordingly there is a desire to provide an improved user interface for hydraulically operated tools.

SUMMARY OF THE INVENTION

In accordance with one aspect of the invention, a hydraulic tool user interface is disclosed. The hydraulic tool user interface includes a rocker section, a drain trigger section, and an activation trigger section. The rocker section includes a first end, a second end, and a first contact portion. The first contact portion is between the first end and the second end. The first contact portion is configured to contact a drain pin. The drain trigger section is at the first end. The activation trigger section is between the first end and the second end. The activation trigger section is configured to contact the second end. The activation trigger section is configured to contact an electrical switch.

In accordance with another aspect of the invention, a hydraulic tool is disclosed. The hydraulic tool includes a housing, a motor, a hydraulic pump, and a user interface. The motor is connected to the housing. The hydraulic pump is connected to the motor. The user interface includes a mount section, a rocker section, a drain trigger section, and an activation trigger section. The mount section is connected to the pump. The rocker section is movably connected to the mount section. The drain trigger section is configured to be movable about the mount section. The activation trigger section is configured to be movable about the mount section.

In accordance with yet another aspect of the invention, a method of assembling a user interface for a hydraulic tool is disclosed. A rocker mechanism is provided. The rocker mechanism is configured to contact a hydraulic drain pin. A drain trigger is connected to a first end of the rocker mechanism. An activation trigger is movably connected to a center section of the rocker mechanism. The activation trigger is configured to contact a second end of the rocker mechanism.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
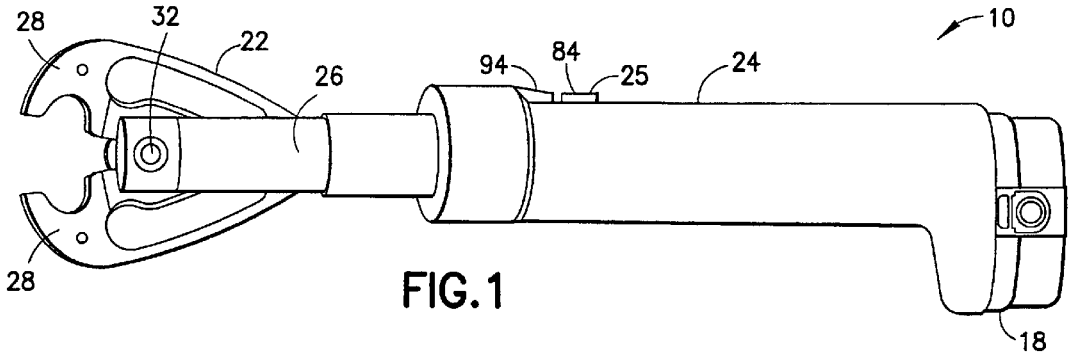
FIG. 1 is an elevational side view of a battery operated, hydraulic tool incorporating features of the invention.

Referring to FIG. 1, there is shown an exploded perspective view of a tool 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

The tool 10 is a hand-held hydraulically operated, battery powered tool. However, features of the invention could be used in a non-battery operated tool. The tool 10 is a crimping tool for crimping an electrical connector onto a conductor, such as an electrical cable for example. However, features of the invention could be used in any suitable type of hydraulically operated tool, such as a cutting tool for example.

Figure 2:
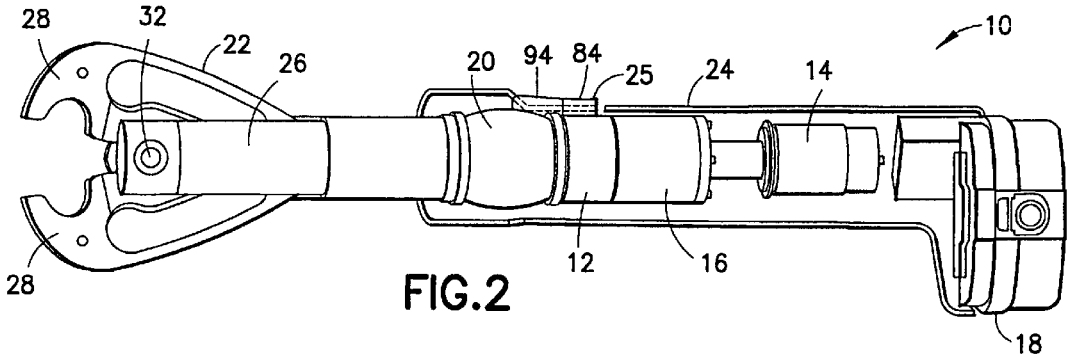
FIG. 2 is a side view of the tool shown in FIG. 1 with a cut away view of the housing.

Referring also to FIG. 2, the tool 10 generally comprises a pump 12, a motor 14, a transmission 16 connecting the motor to the pump, a battery 18, a fluid reservoir 20, a working head 22, and a housing 24. The tool 10 has a user actuated control 25, such as push buttons or a rocker switch for example. However, in alternate embodiments, any suitable type of user actuated control could be provided. The working head 22, in this embodiment, comprises a frame 26, two jaws 28 and rollers (see FIG. 4). However, in alternate embodiments any suitable type of working head could be provided. The jaws 28 are pivotably connected to the frame 26 at a pivot connection 32. The front ends of the jaws are adapted to removably receive crimping dies. However, in an alternate embodiment, the working head could be a die-less crimping head. The rollers 30 are located against the rear ends of the jaws 28; and can be pushed between the rear ends of the jaws. The pivot connection 32 could comprise a spring to bias the jaws 28 towards an open position when the ram 34 (see FIG. 4) is in a rearward position.

Figure 3:
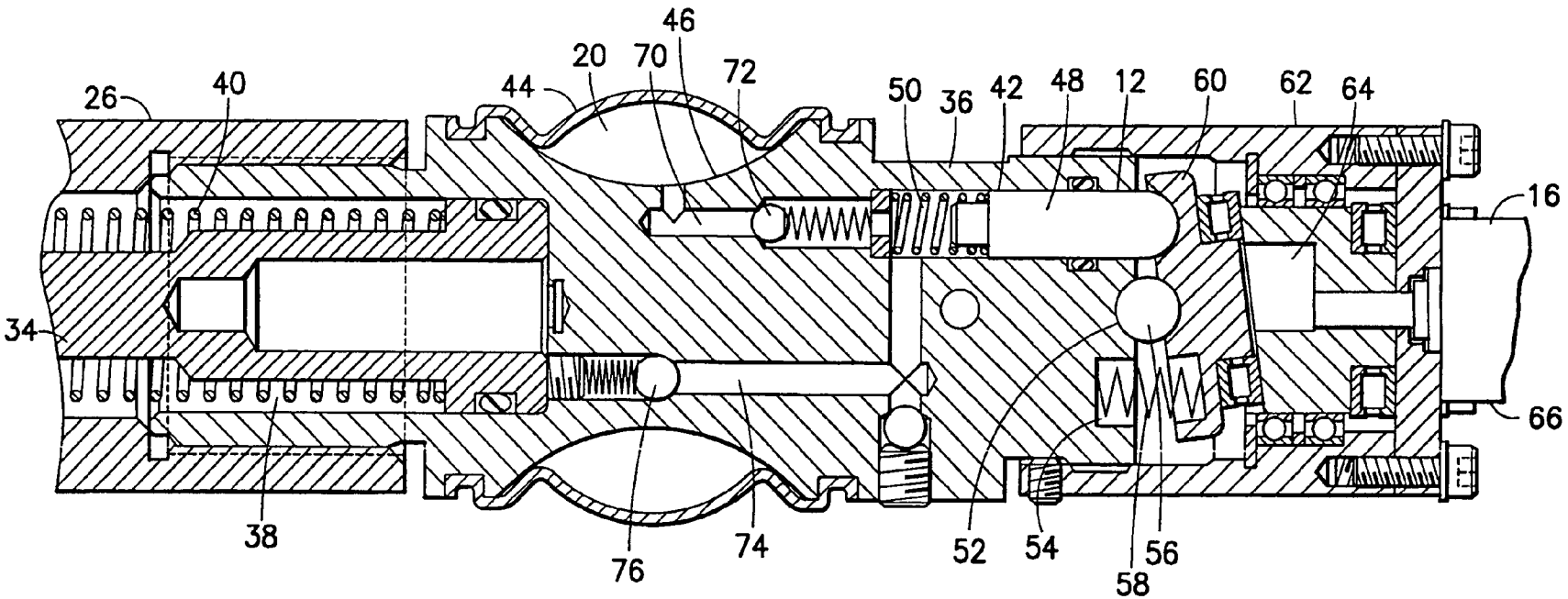
FIG. 3 is a partial cross sectional view of some of the components of the tool shown in FIGS. 1 and 2.
Figure 4:
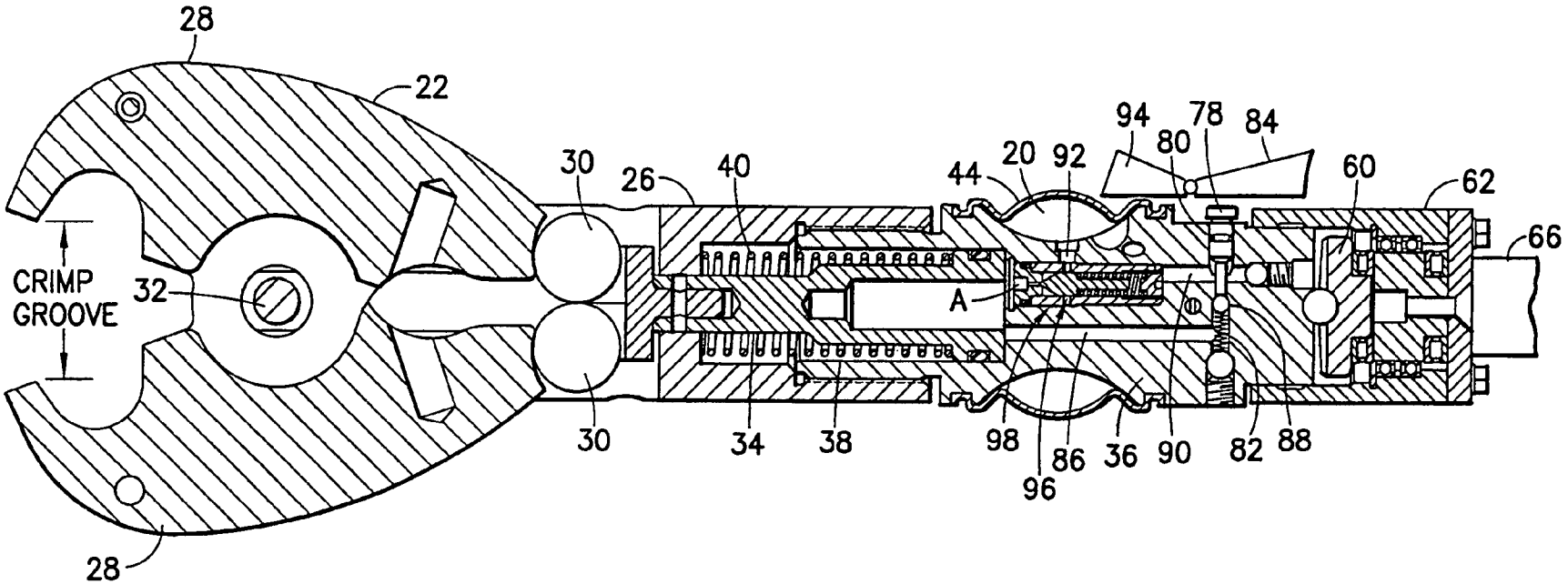
FIG. 4 is a partial cross sectional view of some of the components of the tool shown in FIGS. 1 and 2.

Referring also to FIGS. 3 and 4, the pump 12 could comprise any suitable pump. However, in this embodiment the pump is a wobble plate pump such as described in U.S. patent application Ser. No. 11/429,039 which is hereby incorporated by reference in its entirety. The pump 12 comprises a frame 36. The frame 36 has a front end which forms a ram cylinder 38. The ram 34 is located in the ram cylinder 38 and biased towards a rearward position by a ram spring 40. The front end of the ram 34 is located against the rollers 30. The ram 34 can be moved forward by hydraulic fluid to move the rollers 30 forward and, thus, spread the rear ends of the jaws 28 apart. This causes the front ends of the jaws to be moved towards each other.

The frame 36 forms hydraulic conduits from a piston channel 42 to the rear end of the ram at the ram cylinder 38. Various check valves and a release and/or relief valve are also preferably located in the hydraulic conduits. An exterior side of the frame 36 also forms part of the reservoir 20. A bladder 44 is attached at an annular recess 46 of the frame 36 to form the reservoir 20. However, in an alternate embodiment any suitable type of hydraulic fluid reservoir or hydraulic fluid supply could be provided.

The pump 12 comprises a piston pump member 48 located in the piston channel 42. The piston pump member 48 extends out of the rear end of the frame 36 and is biased outward by a spring 50. The piston member 48 is arranged in the piston channel 42 for reciprocating forward and backward movement. As the piston member 48 moves rearward it draws hydraulic fluid into the piston chamber 42 from the reservoir 20 through the conduit 70 and past check valve 72. As the piston member 48 moves forward, it pushes that hydraulic fluid towards the ram cylinder 38 through conduit 74 and past check valve 76.

The rear end of the frame 36 comprises a pivot member hole 52 and at least one spring hole 54. A pivot member 56 is pivotably located in the hole 52. In this embodiment the pivot member 56 is a ball. However, in alternate embodiments any suitable pivotable connection of the wobble plate 60 to the rear end of the frame 36 could be provided. A spring 58, such as a coil spring, is located in each of the holes 54. In this embodiment only one coil spring 58 is provided. However, in alternate embodiments two to five or more coil springs could be provided. The spring 58 is located on an opposite side of the rear end of the frame 36 from the piston member 48 with the pivot member 56 therebetween.

The transmission 16 generally comprises the wobble plate 60, a transmission case 62, a bevel disk 64 and a gearbox 66. The gearbox 66 is connected to an output shaft of the motor 14. The bevel disk 64 is connected to an output shaft 68 of the gearbox 66. The front end of the bevel disk 64 has an angled front face. The face is angled relative to the center axis. The front end also comprises a counter balance pocket.

The user interface or control 25 includes an activation lever 94 pivotably connected to the frame 36. The lever 94 is preferably biased by a spring in an outward position. However, in alternate embodiments, any suitable type of user activation control could be provided. When the lever 94 is depressed by a user, the motor 14 is activated.

As seen in FIG. 4, the tool 10 includes a hydraulic fluid release system 78. The release system 78 generally comprises a drain pin 80, a drain valve 82, and a retract lever 84. The retract lever 84 is part of the user interface 25. The release system 78 uses these members in combination with the conduits 86, 88, 90, 92 to release hydraulic fluid from the ram cylinder 38 back into the reservoir 20. The drain valve 82 has a spring for biasing the drain valve in a closed position. The drain pin 80 has an end which extends out of the frame 36. The retract lever 84 is pivotably connected to the frame 36. The lever 84 is preferably biased by a spring against the outer end of the drain pin 80. The spring of the drain valve 82 is stronger than the spring of the lever 84. However, the lever can move both inward and outward from a home position shown in FIG. 4. The lever 84 can be depressed by a hand or finger of a user to move the drain pin 80 inward. This can unseat the drain valve and, therefore, open the drain valve 82 to allow release of hydraulic fluid from the ram cylinder 38 back into the reservoir 20.

Figure 5:
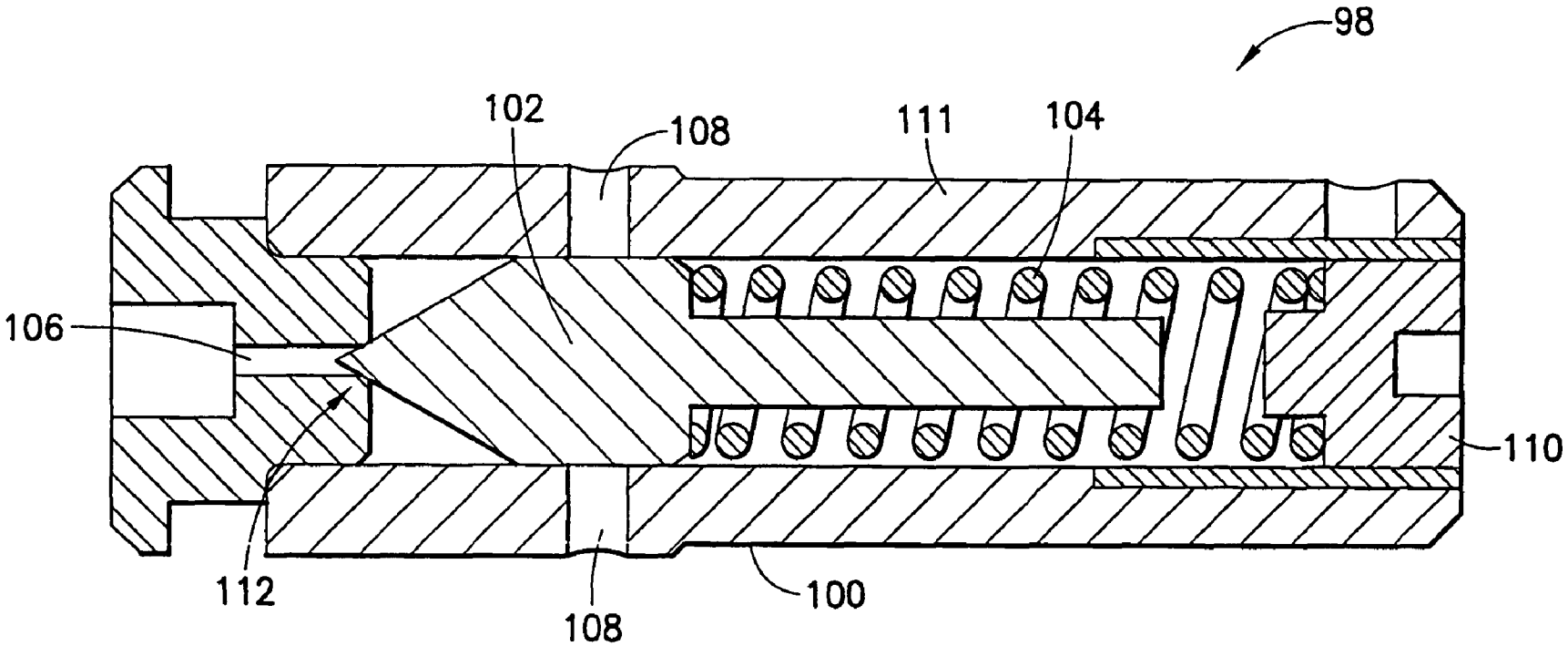
FIG. 5 is an enlarged cross sectional view of the relief valve shown in FIG. 4.

The tool 10 also includes a hydraulic fluid relief system 96. The relief system 96 generally comprises a relief valve 98 connected to the conduit system of the frame 36 between the ram cylinder 38 and the reservoir 20. In this embodiment the relief valve 98 is mounted in the conduit 90 proximate the conduit 92. Referring also to FIG. 5, the relief valve 98 generally comprises a valve body 100, a valve cone 102 and a spring 104. The valve body 100 includes an inlet port 106, outlet ports 108, an adjusting screw 110, and a reduced outer diameter section 111. The valve cone 102 is movably located in the valve body. The spring 104 biases the valve cone 102 into sealing contact with the valve seat 112 formed at the inlet port 106.

When hydraulic pressure in the ram cylinder 38 reaches a predetermined value, the front of the valve cone 102 is unseated from the valve seat 112 (due to hydraulic pressure at the inlet port 106) and hydraulic fluid is allowed to flow from the ram cylinder 38, through the inlet port 106, out the outlet port 108 and back to the reservoir 20 through conduit 92. If the predetermined pressure is not reached, the relief valve 98 remains closed. The relief valve 98 may be adapted to generate an audible sound, such as a "pop" when it is opened. The relief valve 98 could also be adapted to stay open until a predetermined lower hydraulic pressure is reached.

In addition to the audible signaling system noted above, the tool 10 includes a second signaling system comprising a tactile feedback system. In this embodiment the tactile feedback system comprises the lever 84, the drain pin 80 and the spring of the lever 84. The tactile feedback system is coupled to the conduit system and is adapted to signal a user of an occurrence of a predetermined event. For example, the predetermined event could be the relief valve 98 being actuated or a predetermined hydraulic pressure being reached.

The tactile feedback system provides tactile feedback to a hand of a user because the hand of the user will be contacting the lever 84 while the user is actuating the lever 94. More specifically, when the valve 98 opens, some of the hydraulic fluid from the ram cylinder 38 will be pushed into the conduit 88 and push the drain pin 80 outward. The lever 84 will move outward with the spring of the lever 84 being deflected. When the valve 98 closes again, the spring of the lever 84 will move the lever back to its home position; back inward. Because of the reciprocating motion of the piston pump member 48, the valve 98 will repeatedly open and close until the user stops actuating the lever 94. Thus, the tactile feedback system, in this embodiment, will result in the lever 84 moving up and down in a type of vibratory effect on the user's hand; because the valve will repeatedly open and close. However, in an alternate embodiment the tactile feedback might not be vibratory.

In the embodiment described above, the tool has a signaling system for signaling a user of an occurrence of a predetermined event and, more specifically, the signaling system is adapted to generate at least two different signals to the user. In the embodiment described, the two signals include an auditory signal and a tactile signal. However, in alternate embodiments, more than two types of signals could be provided, and the signals could include signals other than auditory and/or tactile, such as visual for example. In another type of alternate embodiment, only a tactile signaling system might be provided.

The invention can relate to a battery powered hydraulic crimp tool. The invention can provide tactile feedback to the operator which indicates that a crimp is complete. Tactile feedback can be generated once the tool's predetermined relief valve set pressure has been achieved.

With the embodiment described above, the battery powered hydraulic crimp tool can be powered by a DC battery coupled to a DC motor which has an output shaft coupled to a gearbox which also has an output shaft. As the shaft rotates, the bevel disk rotates which rotates on the thrust bearing and transfers rotary motion into linear motion of the wobble plate. This activity causes the pump and pump spring to reciprocate. This reciprocating motion pumps hydraulic fluid from the reservoir to the rearward section of the piston ram. As the pump moves in a direction toward the rear of the tool fluid is drawn from the reservoir through the inlet check valve. As the pump moves in a direction towards the front of the tool, fluid is pushed through the outlet check valve and behind the piston ram into the cylinder. As fluid fills the cylinder, the piston ram advances towards the front of the tool forcing the carrier and rollers onto the cam surface of the jaws. As this happens the jaws close and the crimp groove or dies (not shown) crimp the work piece.

Pressure in the cylinder will rise to a predetermined relief valve set pressure. As pressure rises in the cylinder port, the relief valve is subjected to the same pressure as the cylinder. When the pressure is at the predetermined valve set pressure, the valve cone lifts off of the valve seat and the cone shuttles away from port 106 and allows fluid to pass through ports 108 back to the reservoir. As this happens some fluid is permitted to pass over the valve body at a small diameter annular passageway created by reduced outer diameter section 111 and into the conduit holding the drain pin 80.

The resulting hydraulic pressure in the conduit holding the drain pin 80 is much lower than the hydraulic pressure in the cylinder 38 because the majority of escaping fluid is channeled to the reservoir. However, there is still ample pressure to push on the drain pin. The pressure that is applied to the drain pin happens over a very small period of time and causes the drain pin to shuttle in a direction opposite to the drain valve. The drain valve spring is sized to be relatively stiff and the pressure pulse into conduit holding the drain pin cannot provide enough force to move this spring; so the drain valve remains closed. As the drain pin shuttles in a direction opposite to the drain valve, it bumps the retract trigger which provides the tactile feedback to the operator that the predetermined relief valve pressure setting is achieved and, therefore, the crimp is complete.

In addition it should also be noted that an operator can abort the crimp cycle at any point in time by simply activating the retract lever and depress the drain pin; thus actuating the drain valve. When this occurs fluid is allowed to drain from the cylinder through conduits, through the drain valve, and through the annular passageway at the valve 98 back to the reservoir. This activity will cause the crimp jaws to open.

In one type of alternate embodiment the pump could be provided outside of the tool. In another type of alternate embodiment, the tool could be a pneumatic tool rather than a hydraulic tool. Preferably the tool is portably hand held, but in an alternate embodiment only a portion of the tool might be held by a hand of the user.

Referring now also to FIGS. 6-9, one example of the user interface or user actuated control 25 is shown. In this embodiment the control 25 comprises a pivotal mount 114 on the frame 36, an activation trigger 116, a drain trigger 118 and a rocker mechanism 120. The rocker mechanism 120 comprises a center section, or center portion, 122 pivotably connected to the pivotal mount 114. The pivotal mount 114 forms an axis of rotation extending between lateral sides of the rocker mechanism 120. The rocker mechanism, or rocker section, 120 has a first end 124 extending from the center section 122 in a first direction and a second end 126 extending from the center section 122 in a generally opposite second direction. The center section 122 also includes a drain button contact section, or contact portion, 128 for contacting an outer end 130 of the drain pin 80.

Figure 6:
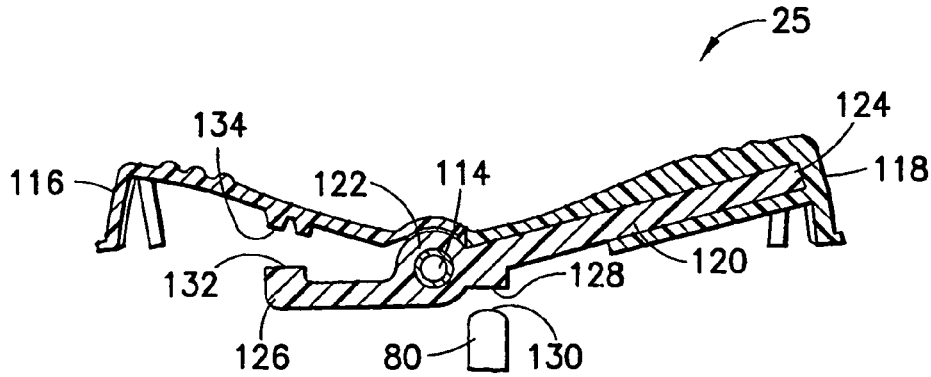
FIG. 6 is a diagram showing components of the user control of the tool shown in FIG. 1 at a home position.

The drain trigger, or drain trigger section, 118 is stationarily mounted on the first end 124 of the rocker mechanism 120 to form the retract lever 84. The activation trigger, or activation trigger section, 116 is pivotably mounted on the center section 122 and/or the pivotal mount 114. FIG. 6 shows the control 25 at a home state. The surface 128 is spaced from the end 130 of the drain button 80. The two triggers 116, 118 are both in upward positions. The second end 126 of the rocker mechanism 120 has a contact surface, or contact portion, 132 which is spaced from the contact surface 134 of the activation trigger 116.

Figure 7:
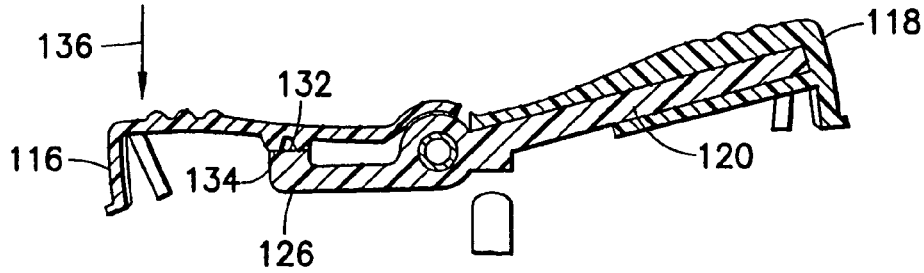
FIG. 7 is a diagram as in FIG. 6 showing the activation trigger partially depressed.
Figure 8:
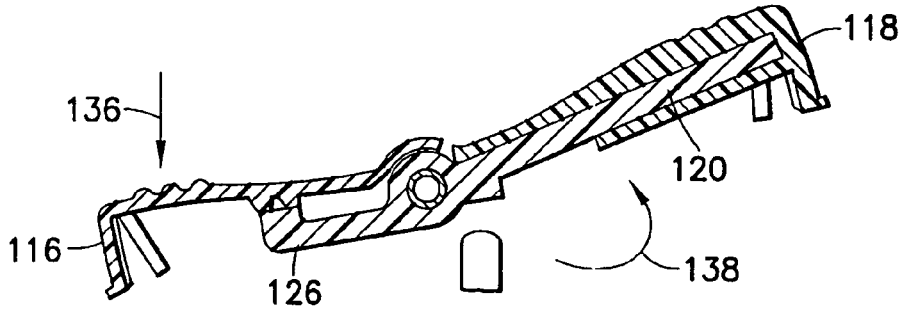
FIG. 8 is a diagram as in FIG. 7 showing the activation trigger fully depressed to actuate an electrical switch.

As seen with reference to FIG. 7, to activate the motor 14 the user depresses the activation trigger 116 until the two contact surfaces 132, 134 meet as shown by arrow 136. Further depression of the activation trigger 116 as seen in FIG. 8 causes the activation trigger 116 to actuate an electrical switch (not shown) and rotate the rocker mechanism 120 upward as shown by arrow 138. The drain trigger 118 is, thus, rotated upward.

Figure 9:
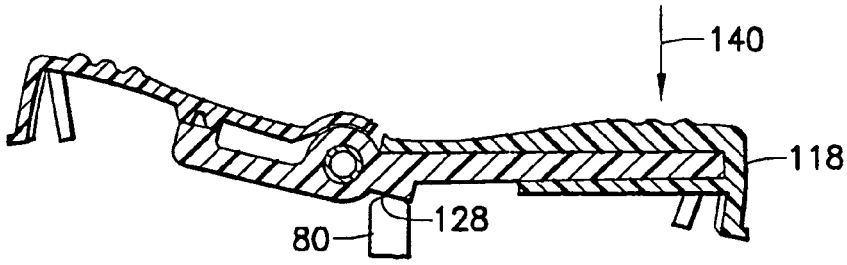
FIG. 9 is a diagram as in FIG. 6 showing the drain trigger depressed to actuate the release system.

As seen with reference to FIG. 9, to retract the ram 34 the user can depress the drain trigger 118 as indicated by arrow 140. This causes the surface 128 to depress the drain pin 80 inward, thereby opening the release valve.

One concept is the three beams all sharing a common pivot point or pivot axis (axis of the mount 114). Further, the drain trigger portion 118 of the rocker switch is longer than the activation trigger portion 116, so it is more likely to snag or contact another object. Once the drain trigger 118 contacts another object and is depressed, it is virtually impossible for the activation trigger portion 116 of the rocker switch to depress and activate the tool 10. In addition, a basic rocker switch is split into two sections instead of one solid piece of plastic. This allows for independent movement of at least one of the rocker switch arms.

The invention ensures the drain trigger 118 on a hydraulic crimping tool 10 will not press the drain button 80 while the activation trigger 116 is engaged. If both are depressed at the same time the tool's 10 hydraulic fluid will cycle through the tool 10 without the pump 12 building pressure. Lying under the drain and activation triggers 118, 116 is the rocker mechanism 120. All three components 116, 118, 120 share a common pivot point. There is some space (about a few of degrees) between the activation trigger 116 and the rocker 120. When the activation trigger 116 is engaged it will first rotate through this open space before it contacts the rocker 120. When the activation trigger 116 comes in contact with the rocker 120, the rocker 120 will then raise on the opposite side, therefore, moving the drain button contact surface 128 away from the drain button 80. About a fraction of a degree later (or about a few degrees later), the activation trigger 116 will contact the electrical switch and activate the motor 14.

The drain button contact surface 128 could be located either on the rocker mechanism 120 or on the drain trigger itself 118. If the drain button contact surface 128 is located on the rocker 120 as it is shown, it can also act as a support rib for the drain trigger 118.

When the drain trigger 118 is depressed, the rocker mechanism 120 will rotate up to the activation trigger 116 but will not cause the activation trigger 116 to rotate. If the drain and activation triggers 118, 116 were one solid piece, they would act as a rocker mechanism, but when one is depressed it would always cause the other to rise by a ratio of their links, which is not desirable to the end user. By designing the triggers 116, 118 such that the drain trigger 118 is tallest (farthest away from the axis of the mount 114) if the tool 10 is laid on a flat surface, it is more likely that the drain trigger 118 would depress first and rotate the rocker mechanism 120 so that its opposite side 126 rises and restricts the activation trigger 116 from contacting the electrical switch. This forms a type of lockout mechanism. This type of control could be used with or without the vibration indicator.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A hydraulic tool comprising:

a housing;

a motor connected to the housing;

a hydraulic pump connected to the motor; and a user interface comprising a drain trigger section and an activation trigger section, wherein at least one of the drain trigger section and the activation trigger section is movable independently of the other one of the drain trigger section and the activation trigger section, wherein the drain trigger section and the activation trigger section are adapted to be actuatable by a user of the hydraulic tool proximate an exterior portion of the housing, and wherein the user interface forms a lockout mechanism adapted to restrict movement of one of the drain trigger section and the activation trigger section when the other one of the drain trigger section and the activation trigger section is depressed by the user.

2. The hydraulic tool of claim 1 wherein the user interface further comprises a mount section and a rocker section, wherein the mount section is connected to the pump, wherein the rocker section is movably connected to the mount section, wherein the drain trigger section is configured to be movable about the mount section, and wherein the activation trigger section is configured to be movable about the mount section.

3. The hydraulic tool of claim 2 wherein the activation trigger section comprises an activation trigger member, and wherein a first end of the activation trigger member is movably connected to the rocker section.

4. The hydraulic tool of claim 2 wherein the user interface is adapted such that the rocker section rotates toward the activation trigger section when the drain trigger is depressed.

5. The hydraulic tool of claim 1 wherein the user interface is adapted such that the activation trigger section is restricted from actuating an electrical switch of the hydraulic tool when the drain trigger is depressed.

6. The hydraulic tool of claim 1 wherein a length of the drain trigger section is greater than a length of the activation trigger section.

7. The hydraulic tool of claim 1 wherein the user interface is adapted to lock the activation trigger section in position when the drain trigger section is depressed.

8. The hydraulic tool of claim 1 wherein the user interface is adapted to prevent the drain trigger from moving when the activation trigger is depressed.

9. A hydraulic tool user interface comprising:

a rocker section comprising a first end, a second end, and a center portion between the first end and the second end, wherein the center portion forms a first axis;

a drain trigger section at the first end; and an activation trigger member connected to the rocker section, wherein the activation trigger member is pivotable relative to the rocker section about the first axis, wherein the drain trigger section is adapted to be movable independently of the activation trigger member, and wherein the rocker section is adapted to lock the activation trigger member in position when the drain trigger section is depressed.

10. The hydraulic tool user interface of claim 9 wherein the rocker section further comprises a first contact portion between the first end and the second end, wherein the first contact portion is adapted to contact a drain pin.

11. The hydraulic tool user interface of claim 10 wherein the interface is adapted to move the first contact portion away from the drain pin when the activation trigger member is depressed.

12. The hydraulic tool user interface of claim 9 wherein the activation trigger member is movably connected between the first end and the second end of the rocker section, and wherein the activation trigger member is adapted to actuate an electrical switch.

13. The hydraulic tool user interface of claim 9 wherein when the activation trigger member is engaged the activation trigger member is pivotable relative to the rocker section until contacting the second end of the rocker section.

14. The hydraulic tool user interface of claim 9 wherein a length of the drain trigger section is longer than a length of the activation trigger member.

15. The hydraulic tool user interface of claim 9 wherein the user interface forms a lockout mechanism adapted to restrict movement of one of the drain trigger section and the activation trigger member when the other one of the drain trigger section and the activation trigger member is depressed by the user.

16. The hydraulic tool user interface of claim 9 wherein the user interface is adapted to prevent the drain trigger from moving when the activation trigger is depressed.

17. A hydraulic tool comprising:

a housing;

a motor connected to the housing;

a hydraulic pump connected to the motor; and a hydraulic tool user interface as in claim 9 connected to the housing.

18. A method of assembling a user interface for a hydraulic tool, the method comprising:

providing a drain trigger; and providing an activation trigger proximate the drain trigger, wherein the activation trigger is a separate member from the drain trigger, wherein the activation trigger is adapted to be movable independently of the drain trigger member, and wherein the user interface is adapted to prevent the drain trigger from moving when the activation trigger is depressed.

19. The method of claim 18 further comprising:

providing rocker mechanism, wherein the drain trigger is connected to a first end of the rocker mechanism, and wherein the rocker mechanism is configured to contact a hydraulic drain pin of the hydraulic tool; and movably connecting the activation trigger to a center section of the rocker mechanism.

20. The method of claim 19 wherein the activation trigger is adapted to contact a second end of the rocker mechanism.

* * * * *